US005851039A

United States Patent [19]

Fänger et al.

[11] Patent Number: 5,851,039

[45] Date of Patent: Dec. 22, 1998

[54] LOWER BLOCK APPARATUS

[75] Inventors: Alfred Fänger, Wetter; Udo Gersemsky, Herdecke; Klaus-Jürgen Winter, Wetter, all of Germany

[73] Assignee: Mannesmann Aktiengesellschaft, Düsseldorf, Germany

[21] Appl. No.: 783,438

[22] Filed: Jan. 16, 1997

[30] Foreign Application Priority Data

Jan. 18, 1996 [DE] Germany ..... 196 02 931.7

[51] Int. Cl.[6] ..... B66C 1/34; B66D 3/06

[52] U.S. Cl. ..... 394/82.1; 254/401; 254/403

[58] Field of Search ..... 294/82.1, 82.11, 294/82.12, 85.15; 254/390, 393, 401–403, 408, 409, 415

[56] References Cited

U.S. PATENT DOCUMENTS

| | | | |
|---|---|---|---|
| 1,896,266 | 2/1933 | White | 254/401 |
| 2,317,215 | 4/1943 | Parker et al. | 254/402 |
| 2,570,320 | 10/1951 | Christensen | 254/401 |
| 2,781,671 | 2/1957 | Devonshire | 294/82.1 |
| 3,179,376 | 4/1965 | Botten | 294/82.1 |
| 3,210,115 | 10/1965 | Graham et al. | 394/82.15 |
| 3,517,761 | 6/1970 | Bartley et al. | 294/82.1 |

FOREIGN PATENT DOCUMENTS

| | | |
|---|---|---|
| 31602 | 7/1968 | Germany . |
| 3220253 | 12/1982 | Germany . |

*Primary Examiner*—Dean Kramer

*Attorney, Agent, or Firm*—Cohen, Pontani, Lieberman & Pavane

[57] ABSTRACT

A lower block, in particular for lifting tackle, having laterally arranged, rotatably mounted pulleys and a load hook which is mounted rotatably about a vertical axis and a horizontal axis and is connected via a connecting element to the pulleys. In order to reduce the overall height and the work involved in assembly of the lower block without correspondingly reducing its load bearing capacity, journals are formed integral with the connecting element and are arranged at opposite lateral ends thereof for supporting the pulleys. The load hook is arranged and axially secured in a recess defined in and open toward the bottom of the connecting element.

7 Claims, 3 Drawing Sheets

LOWER BLOCK APPARATUS

BACKGROUND OF THE INVENTION

1. Field of the Invention

The invention relates to a lower block, and more particularly to a symmetrical one-piece lower block having a load hook rotatably mounted therein.

2. Description of the Related Art

Lower blocks used as part of an apparatus to raise, support and transport a load are typically sized according to their load-bearing capacity, i.e. a large lower block is capable of bearing a large load. Prior efforts to reduce the overall size of the lower block while maintaining its load-bearing capacity have heretofore been unsuccessful.

For example, German regulation DIN 15 408 discloses a lower block having two rope pulleys which are laterally supported via bearings on an axle. A load hook having a short shank is fastened below and to the axle using tension straps in a vertically and horizontally rotatable manner. The load hook has a horizontal pivot pin on which an axial bearing provided on the load hook shank is supported. This configuration permits vertical rotation of the load hook. The ends of the pivot pin extend beyond the tension straps and are supported in an axially secured manner in passage openings provided for this purpose in the tension straps. Lower blocks configured accordingly are disadvantageously large in overall height. Furthermore, lower blocks of this type have a multiplicity of component parts, which entails a considerable amount of work for assembly and service.

Lower blocks may also include a rope-pulley axle having a horizontal passage opening through which the shank of the load hook passes. The load hook is supported via an axial bearing on the top side of the rope-pulley axle. Although this lower block has a small overall height, its loading capacity is clearly lower than that of lower blocks disclosed in German regulation DIN 15 408 due to the passage opening in the rope-pulley axle. In the case of this lower block, too, numerous component parts require substantial assembly and service effort.

Accordingly, it is desirable to produce a compactly designed lower block capable of carrying a large load. It is also desirable to design such a lower block having a minimum of component parts to facilitate assembly and service.

SUMMARY OF THE INVENTION

It is accordingly an object of the present invention to provide a lower block having a reduced overall height without correspondingly reducing the loading capacity of the block.

The lower block of the present invention is advantageously constructed of a substantially solid unitary connecting element having integrally formed covering caps and concentric journals defined at the opposite lateral ends thereof. The unitary connecting element further comprises a bottom portion having an inner recess defined therein and near the center of the connecting element, the recess being configured for accepting and axially securing a load hook therein.

The lower block of the present invention comprises a substantially solid unitary symmetrical connecting element having a narrow mid-section which broadens at its opposite lateral ends and terminates in two longitudinally oppositely disposed covering caps. For ease of description, and with the understanding that the connecting element of the present invention is generally symmetrical, the elements comprising a single side of the connecting element will be described below unless otherwise indicated. At a lateral end of the connecting element, a journal extends coaxial to the connecting element within the covering cap. A stop surface coaxial with the journal defines a transition between the connecting element and journal. A bearing rests and is axially secured against the stop surface by a retaining ring.

The covering cap further comprises an inner covering cap and an outer covering cap—the inner covering cap is integrally formed with the connecting element and has a non-continuous peripheral side wall which, together with the journal, define an annular outer recess therebetween. A pulley is fixedly and rotatably supported on the bearing for rotation within the outer recess and about the journal. The peripheral side wall of the inner covering cap terminates at an upper rim and includes two notched sections. The inner covering cap further comprises a trough or recess defined in the upper rim of its peripheral side wall and configured to accept a complementary projection defined on the outer covering cap for assuring the correct alignment of the inner and outer covering caps.

The outer covering cap comprises a non-continuous peripheral side wall which terminates at an upper rim. A projection extends from the upper rim of the outer covering cap to and coaxial thereto. The projection is configured for friction or positive-locking mating engagement with the trough or recess defined in the upper rim of the inner cap peripheral wall. The peripheral side wall of the outer covering cap includes two notched sections corresponding in size and location to the notched sections of the inner covering cap peripheral side wall. The outer covering cap is removably secured to the connecting element at the journal by fastening means such as, for example a screw. When secured to the connecting element, thusly, the outer covering cap substantially encloses the pulley, bearing and retaining ring within the outer recess of the inner covering cap with the exception of a partial opening in the bottom portion of the peripheral side wall where the notched sections of the inner covering cap and the outer covering cap align.

The connecting element further defines a generally downwardly facing and cylindrical inner recess located near the center of the narrow mid-section and configured for securingly accepting a load hook.

The load hook of the present invention comprises a shank portion having an axial bearing disposed horizontally thereabout. The axial bearing is rotatable about a substantially vertical axis. The axial bearing comprises a ball socket having a plurality of ball bearings disposed therein. A ball cage is provided on the axial bearing for securing the plurality of ball bearings within the ball socket. The shape of the shank portion of the load hook and the axial bearing is substantially complementary to the shape of the inner recess of the connecting element so that the shank portion and axial bearing of the load hook may be inserted into the inner recess of the connecting element and secured therein in a positive-locking manner.

Two securing pins are disposed within two respective horizontal bores defined within the connecting element. The pins may be further secured within their respective bores by securing means such as, for example serrated rings.

The ball socket further has two generally horizontal tangential grooves defined on opposite circumferential sides thereof. The grooves are each configured to accept a securing pin when the load hook shank portion and axial bearing are inserted into the inner recess of the connecting element to securingly mount the load hook thereto and to axially fix the position of the load hook therein. The axial securing of the load hook within the connecting element as previously described permits high tensile loading of the load hook, as the securing pins are subjected only to shear loading.

The present invention advantageously eliminates the various component parts previously required to rotatably support a load hook and replaces them with a substantially solid, unitary connecting element which combines the vertical positioning components, e.g. pulleys and pulley axles, and load hook supporting components, e.g. horizontal pins on the load hook, so as to subject the load hook supporting elements to only the shear forces and to subject the load hook to only torsional forces.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings wherein like reference characters denote similar elements throughout the several views.

DETAILED DESCRIPTION OF THE PRESENTLY PREFERRED EMBODIMENTS

Figure 1:
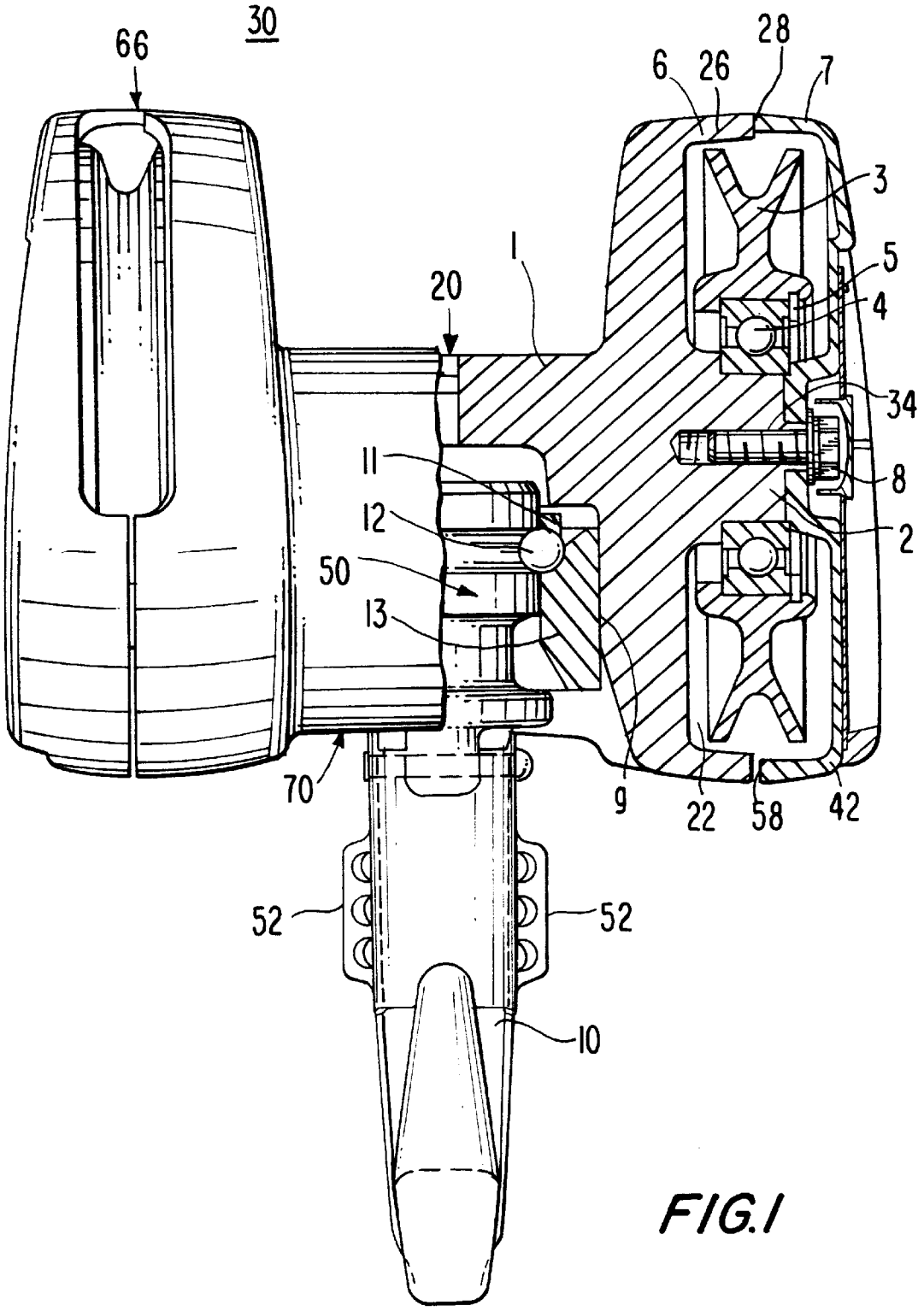
FIG. 1 is a partial cross-sectional front view of a lower block configured in accordance with the present invention.
Figure 2:
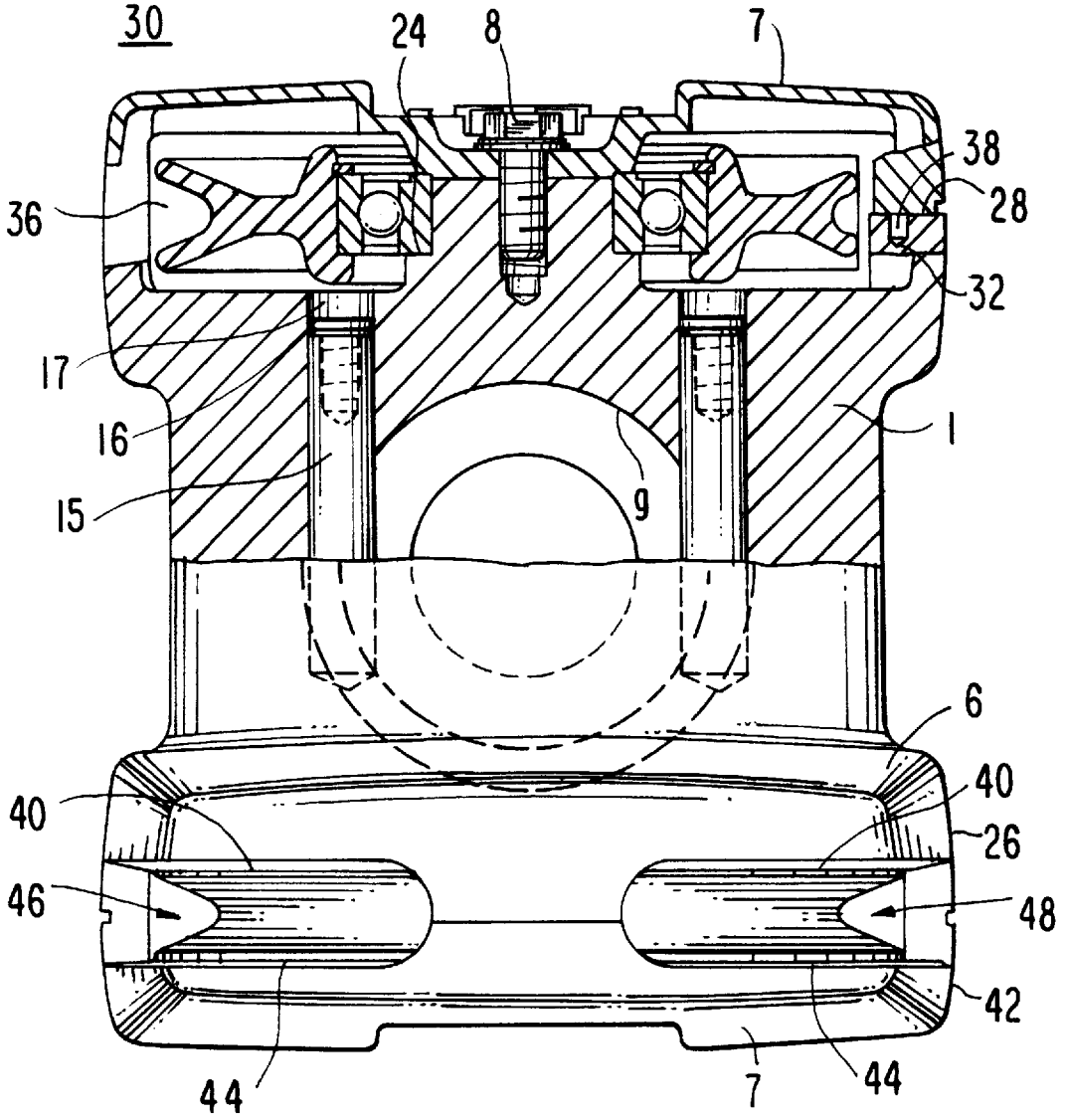
FIG. 2 is a partial cross-sectional top view of the device of FIG. 1.

Referring now to the drawings, and in particular to FIGS. 1 and 2, a diagrammatic representation of a lower block configured in accordance with the present invention is generally designated at 30. For ease of description, only the right-hand side of FIG. 1 will be described in detail below. It is to be clearly understood, however, that, due to the symmetrical design of the present invention, such detailed description applies equally to the left-hand side of FIG. 1. The lower block 30 is comprised of a substantially solid unitary and generally symmetrical connecting element 1 having a mid-section 20 which broadens at its lateral ends to form a covering cap 66. The covering cap 66 further comprises in inner covering cap 6 and an outer covering cap 7—the inner covering cap 6 having a non-continuous peripheral side wall 26 having two notched sections 40 defined therein. The side wall 26 terminates at an upper rim 28 having a recess or annular trough 32 defined therein. (FIG. 2). It will be apparent to one of ordinary skill in the art that the recess or annular trough 32 need not be continuous, but instead, may comprise a plurality of recesses configured in any sequence about the upper rim 28 of the side wall 26.

A concentric journal 2 having a bore 34 defined therein extends within the inner covering cap 6 coaxial with the connecting element 1 and comprises part of the unitary connecting element 1. In a preferred embodiment, the bore 34 has an internally threaded portion. A stop surface 24 defines a transition point between the connecting element 1 and the journal 2.

A bearing 4 is disposed about the journal 2 in abutting relation to the stop surface 24 and secured thereon by a retaining ring 5.

The side wall 26 of the inner covering cap 6 and the journal 2 define an outer recess 22 therebetween. A pulley 3 is fixedly and rotatably supported on the bearing 4 for rotation about the journal 2 within the outer recess 22.

The outer covering cap 7 comprises a non-continuous peripheral side wall 42 which terminates at an upper rim 58. The peripheral side wall 42 of the outer covering cap 7 includes two notched sections 44 defined therein corresponding in size and location to the notched sections 40 of the inner covering cap 6 peripheral side wall 26. The outer covering cap 7 is fixedly and removably securable to the connecting element 1 at the journal 2 by fastening means such as, for example a screw 8, which threadedly engages the internally threaded portion of the bore 34. When secured to the connecting element 1, thusly, the outer covering cap 7, inner covering cap 6 and journal 2 define an annular chamber 36. The notched sections 44 in the outer covering cap 7 side wall 42 align with the notched sections 40 in the inner covering cap 6 side wall 26 so as to form two openings 46 and 48 at the top of the covering caps 6, 7. (FIG. 2). A rope or other similar suspension assisting article may be placed around the pulley 3 so that it passes out of the openings 46 and 48 to vertically suspend the lower block 30. The rope and pulleys 3 may be used to selectively change the vertical position of the lower block 30.

Except for the openings 46 and 48, the pulley 3, bearing 4 and retaining ring 5 are sealingly contained within the annular chamber 36 by the inner and outer covering caps 6, 7.

The upper rim 58 of the side wall 42 of the outer covering cap 7 further comprises a projection 38 for complementary interlocking engagement with the recess or annular trough 32 disposed about the upper rim 28 of the side wall 26 of the inner covering cap 6. The projection 38 and annular trough 32 provide a friction or positive-locking mating engagement between the inner covering cap 6 and outer covering cap 7 to ensure proper orientation therebetween and to provide rotation-free positioning of the outer covering cap 7 on the inner covering cap 6.

The connecting element 1 further comprises a bottom portion 70 having a generally cylindrical inner recess 9 defined therein. The inner recess 9 opens in a generally 10 downward direction (in FIG. 1). Two generally horizontally disposed bores 17 are provided in the connecting element 1 which tangentially intersect opposite circumferential edges of the inner recess 9 in overlapping fashion.

A load hook 10 comprises shank portion having an axial bearing 50 disposed horizontally thereabout—the axial bearing 50 being rotatable about a substantially vertical axis. The axial bearing 50 comprises a ball socket 11 having a plurality of ball bearings 12 disposed therein. A ball cage 13 is provided for securing the plurality of ball bearings 12 within the ball socket 11. The shape of the axial bearing 50 conforms substantially to the shape of the inner recess 9 defined in the connecting element 1. Accordingly, the load hook 10 may be releasably inserted into the inner recess 9 of the connecting element 1 and secured therein by the axial bearing 50 in a positive locking manner. In a preferred embodiment, the load hook 10 includes grippable surfaces 52 to ensure a firm grip by the operator.

Figure 3:
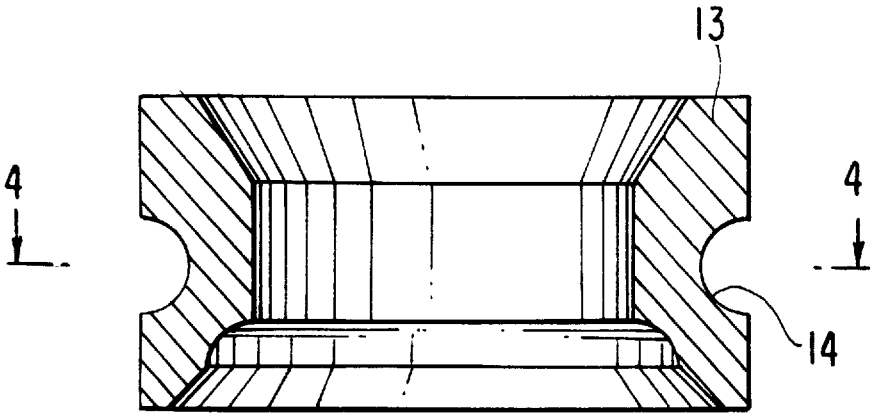
FIG. 3 is a longitudinal cross-sectional view of the ball socket of the axial bearing of the present invention.
Figure 4:
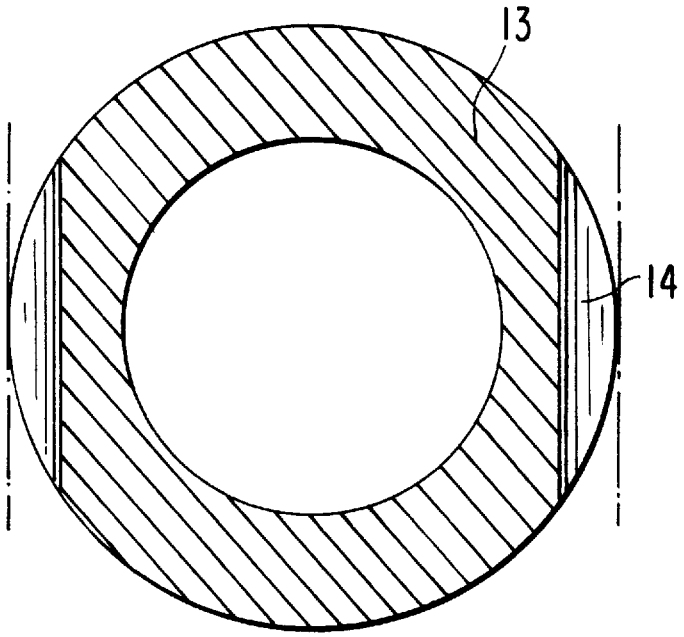
FIG. 4 is a cross-sectional view of the ball socket taken along the line A—A of FIG. 3.

Referring next to FIGS. 3 and 4, the axial bearing 50 includes two tangential grooves 14 disposed on circumferentially opposite sides of the ball cage 13. The grooves 14 serve to secure the bearing 50 within the inner recess 9 and prevent axial movement of the ball cage 13 therein. Of course, the load hook 10 is still rotatable about a substantially vertical axis, assisted by the ball socket 11 and plurality of ball bearings 12. Although substantially semi-circular in cross-section (see FIG. 3), the grooves 14 may be configured of other geometric cross-sections. When the load hook 10 is inserted in the inner recess 9, the tangential grooves 14 of the ball cage 13 align substantially with the bores 17 of the connecting element 1.

Two pins 15 are held within the bores 17 by serrated rings 16 which frictionally engage the side walls of the bores 17. It will be obvious to those of ordinary skill in the art that other interference-type securing means may be used to secure the pins 15 within the bores 17. With the load hook 10 inserted in the recess 9, the pins 15 engage the tangential grooves 14 in a positive-locking manner thereby fixing the load hook 10 in the inner recess 9 and obstructing the axial movement of the ball cage 13 axial bearing 50 within the inner recess 9. The load hook 10 may still rotate axially about a substantially vertical axis by means of the ball socket 11 and plurality of ball bearings 12. In a preferred embodiment, the pins 15 are subject only to shear loading, with torsional loading being isolated and born by the connecting element 1 and load hook 10. This results in an increased load bearing capacity by the connecting element 1 and load hook 10.

In operation, the lower block 30 of the present invention is suspended by a pair of ropes (not shown), or other similar suspension enabling article, which are threaded through the openings 46, 48 in the inner covering cap 6 and outer covering cap 7, through the chamber 36 and around the pulleys 3. The ropes may be lengthened or shortened as desired to alter the vertical suspension position of the lower block 30. When configured thusly, the lower block 30 of the present invention is movable about a substantially horizontal axis, i.e. the longitudinal axis of the connecting element 1, and the load hook 10 is rotatable about a substantially vertical axis. The complementary configuration of the inner recess 9 and load hook 10 and the interlocking engagement between the pins 15 and grooves 14 subject the pins 15 only to shear forces thereby increasing the torsional load bearing capacity of the connecting element 1 and load hook 10.

The present invention advantageously eliminates the various component parts previously required to rotatably support a load hook and replaces them with a substantially solid, unitary connecting element which combines the vertical positioning components, e.g. pulleys and pulley axles, and load hook supporting components, e.g. horizontal pins on the load hook, so as to subject the load hook supporting elements to only the shear forces and to subject the load hook to only torsional forces.

The compact design of the present invention yields a lower block 30 having a reduced profile without a corresponding reduction in load bearing capacity. In addition, the unitary construction of the lower block 30 of the present invention produces a lower block 30 that is easier to assemble and disassemble and which has fewer serviceable parts.

The invention is not limited by the embodiments described above which are presented as examples only but can be modified in various ways within the scope of protection defined by the appended patent claims.

What is claimed is:

1. A lower block apparatus comprising:

a connecting element having a bottom portion with a recess defined therein;

two journals disposed on opposite lateral ends of said connecting element, wherein said connecting element and said two journals comprise one unitary formed piece;

two pulleys, one of said two pulleys being supported on each of said two journals;

an axial bearing disposed and axially secured in said recess; and a load hook supported by said axial bearing for rotation about a substantially vertical axis.

2. The lower block apparatus defined in claim 1, wherein said load hook is supported in said axial bearing in a positive-locking manner.

3. The lower block apparatus defined in claim 1, further comprising:

two pins disposed within said connecting element for interlocking engagement with said axial bearing; and wherein said axial bearing further comprises a ball socket having two substantially horizontal tangential grooves defined therein, said grooves being configured for interlocking engagement with said pins whereby axial movement of said axial bearing is restricted by said interlocking engagement of said pins and said tangential grooves.

4. The lower block apparatus defined in claim 1, further comprising two covering caps disposed on opposite lateral ends of said connecting element, said covering caps further comprising inner covering caps being formed integral with said connecting element, wherein said two pulleys are disposed within said two covering caps.

5. The lower block apparatus defined in claim 1, wherein said load hook is rotable about a horizontal axis.

6. A lower block apparatus, comprising:

a connecting element having a bottom portion with a recess defined therein;

two journals disposed on opposite lateral ends of said connecting element;

two pulleys, one of said two pulleys being supported on each of said two journals;

an axial bearing disposed and axially secured in said recess; and a load hook supported by said axial bearing for rotation about a substantially vertical axis;

wherein said connecting element is configured as a unitary device and comprises two covering caps disposed on opposite lateral ends of said connecting element thereby forming an outer periphery of said connecting element, said covering caps being partially formed integral with said connecting element, said covering caps protecting said pulleys and two bearings, one of said two bearings being supported on each of said journals for rotation of said pulleys thereabout;

wherein said recess is disposed approximately in the middle of said connecting element; and wherein said journals are integrally formed and concentric with said connecting element.

7. A lower block apparatus comprising:

a connecting element having a bottom portion with a recess defined therein;

two journals disposed on opposite lateral ends of said connecting element;

two pulleys, one of said two pulleys being supported on each of said two journals;

axial bearing disposed and axially secured in said recess;

a load hook supported by said axial bearing for rotation about a substantially vertical axis;

two pins disposed within said connecting element for interlocking engagement with said axial bearing; and wherein said axial bearing further comprises a ball socket having substantially horizontal tangential grooves defined, therein, said grooves being configured for interlocking engagement with said pins whereby axial movement of said axial bearing is restricted by said interlocking engagement of said pins and said tangential grooves.

* * * * *